United States Patent [19]

Friedrich et al.

[11] 3,991,928

[45] Nov. 16, 1976

[54] METHOD OF FABRICATING TITANIUM ALLOY MATRIX COMPOSITE MATERIALS

[75] Inventors: Leonard A. Friedrich, West Hartford; David A. Rutz, Manchester, both of Conn.; Louis E. Dardi, Mushegon, Mich.

[73] Assignee: United Technologies Corporation, Hartford, Conn.

[22] Filed: Aug. 22, 1974

[21] Appl. No.: 499,641

[52] U.S. Cl. ..... 228/190; 228/193; 228/234; 228/263

[51] Int. Cl.[2] ..... B23K 19/00

[58] Field of Search ..... 29/504, 471.1, 494, 29/497.5, 498, 191.2, 191.4, 191.6, 195; 228/190, 193, 234, 263

[56] References Cited

UNITED STATES PATENTS

| | | | |
|---|---|---|---|
| 3,471,270 | 10/1969 | Carlson | 29/191.4 X |
| 3,717,443 | 2/1973 | McMurray et al. | 29/191.4 |
| 3,748,721 | 7/1973 | Alexander | 29/471.3 |

OTHER PUBLICATIONS

Kreider (Editor), *Composite Materials, vol.* 4, Sept. 1974, Academic Press, Inc., New York, N.Y. pp. 282–283, 304, 315.

Hamilton, "Diffusion Bonded Titaium–Borsic Composites" *Journal of Metals*, Mar. 1969, p. 25A.

Hamilton, "Development of Ti–6Al–4V Borsic Composites", *Metal Maxtrix Composites – Symposium of the Metallurgical, Soc. of AIME*, pp. 33–37, May 12–13,1969, B.M.I. Columbus, Ohio, N.T.I.S. AD695046.

Collins, "Properties & Fracture Modes of Borsic-Ti". N.T.I.S. publication no. AD–776, 793, pp. 1–6, 5/31/74.

*Primary Examiner*—Al Lawrence Smith
*Assistant Examiner*—K. J. Ramsey
*Attorney, Agent, or Firm*—Richard N. James

[57] ABSTRACT

Fiber-reinforced titanium alloy composite materials and their manufacture are disclosed. Beta-titaium alloy foils are alternated with arrays or silicon carbide coated boron fibers and consolidated at a pressure of at least 22 ksi within the temperature range of 1250°–1275° F.

7 Claims, 4 Drawing Figures

VACUUM HOT PRESS FIBER-FOIL CONSOLIDATION

VACUUM HOT PRESS FIBER-FOIL CONSOLIDATION

TENSILE STRENGTH, KSI
160
140
120
100
80
60
40
20
DELAMINATION
5
10
15
20
25
FABRICATION PRESSURE, KSI

TENSILE STRENGTH, KSI
200
180
160
140
120
100
80
60
40
20
TI-6AI-4V MATRIX
C.P. TITANIUM MATRIX
1150
1200
1250
1300
1350
1400
FABRICATION TEMPERATURE, °F

METHOD OF FABRICATING TITANIUM ALLOY MATRIX COMPOSITE MATERIALS

BACKGROUND OF THE INVENTION

1. Field of the Invention

The present invention relates to composite materials. More particularly, this invention is directed to the fabrication of fiber-reinforced titanium alloy matrix composite materials. Accordingly, the general objects of the present invention are to provide novel and improved methods and materials of such character.

2. Description of the Prior Art

Fiber-reinforced composite materials have attracted considerable interest in recent years. Such interest has been particularly strong within the aerospace industry where technological advances are becoming ever more dependent upon the development of light weight metal composites of exceptional strength. Composite metallic structures, which are reinforced with high strength, high modulous filaments or fibers having a high length-to-diameter ratio, have been demonstrated to have high specific properties.

With particular respect to the aerospace industry, titanium-based composites have been considered for high temperature applications because of the high-temperature strength and low density of titanium and its alloys. Fiber-reinforced titanium-based composites, if available, would exhibit increased temperature capability; improved shear, transverse, and off-axis properties; and better erosive environment durability compared with presently available aluminum matrix and polymeric matrix composite systems.

Returning, briefly, to a general discussion of fiber-reinforced materials, the efficiency of transfer of tensile stress from a matrix to a filament within the matrix depends upon the integrity of the bond between the filament and the matrix material. Assuming a good bond, optimum strength of the composite material will be achieved if the major portion of an applied load is carried by the reinforcing fibers. In order for this to occur, the fibers must be strong, have a high length-to-diameter ratio and must be properly oriented with regard to the direction of the applied load. Because of its commercial availability, strength and desirable aspect ratio; i.e., a high length-to-diameter; boron filaments have attracted considerable attention for use as reinforcing fibers. Commercially available boron fibers are, in fact, tungsten filaments which have been coated with boron by means of a continuous vapor deposition process.

Previous attempts to fabricate boron fiber reinforced titanium alloy matrix composite materials have met with only limited success. In order to provide a usable product, sheets of the matrix material and layers of the reinforcing fibers are stacked so that the top of each reinforcing fiber is positioned opposite the bottom of a superimposed metal sheet. The stacked layers are laminated, typically by a vacuum hot pressing operation, into an integrally bonded composite structure which can thereafter be machined into the desired form. It has been established that, at consolidation temperatures sufficiently high to promote bonding of titanium matrix material, layer to layer within the stack, an interfacial reaction occurs between boron fibers and the matrix resulting in the formation of a layer of intermetallic compound. Fracture events within the plurality of brittle layers of intermetallic compound which occur throughout the laminate have limited the strain capability and thus the strength of previously available boron titanium composite materials.

SUMMARY OF THE INVENTION

The present invention overcomes the above briefly discussed deficiencies of the prior art by providing a novel and improved technique for the production of boron fiber reinforced titanium alloy matrix composite materials and the materials resulting from the practice of such novel technique. The present invention thus encompasses the fabrication of titanium alloy matrix composite materials having highly desirable properties through the use of appropriate materials and observing certain critical process parameters.

In accordance with the present invention, beta-titanium alloys are employed as the matrix material. These titanium alloys are reinforced with silicon carbide coated boron fibers. During the lamination or consolidation step performed on a stack of superimposed layers of fibers and beta-titanium alloy foils, a pressure of at least 22 ksi is applied and the temperature is maintained in the range of 1250°–1275° F.

BRIEF DESCRIPTION OF THE DRAWING

The present invention may be better understood and its numerous objects and advantages will become apparent to those skilled in the art by reference to the accompanying drawing in which.

DESCRIPTION OF THE PREFERRED EMBODIMENT

In accordance with the present invention the matrix material is a beta-titanium alloy. It will be understood that the term "beta-titanium" means an alloy of titanium which is characterized by the presence of significant amounts of beta phase, either alone, or in combination with alpha phase, and thus use of the so called "alpha-beta" alloys (such as Ti-6Al-4V) constitutes part of this invention. Particularly good results have been achieved with Ti-6Al-4V alloy (AMS 4911). However, other beta-titanium alloys such as, for example, Ti-13V-11Cr-3Al (AMS 4917) Ti-11.5-Mo-6Cr-4.5 Sn (beta 3), and Ti-3Al-8V-6Cr-4Mo-4Zr may be employed. The beta-titanium alloy is supplied by the manufacturer in the form of a sheet or foil, indicated at 10 in FIG. 1, having a thickness of from 5 to 10 mils. The foil is scratch-brushed and degreased before being used in the manner to be described below.

The reinforcing fibers, indicated at 12 in FIG. 1, are silicon carbide coated boron filaments; the boron filaments having been produced in the manner well known in the art by the vapor deposition of boron on a tungsten filament. Silicon carbide coated boron fibers, sold under the trademark BORSIC, are available from Composite Materials Corporation, Broad Brook, Connecticut. Such BORSIC fibers are available with a nominal diameter of 4.2 mils. and 5.7 mils.; 4.2 mil. fibers having been employed in the tests reported herein. The thickness of the silicon carbide coating on the fibers is in the range of 0.00072 to 0.0015 inches. The fibers are positioned on the surface of the beta-titanium alloy foil in parallel orientation. Typically, there will be 180 BORSIC fibers per inch. The fibers are initially positioned on the matrix material by means of fugitive bondings; i.e., a suitable plastic such as polystyrene is employed to maintain the fibers in an evenly spaced parallel orientation. The plastic material is selected such that it will evaporate during the consolidation step to be described below.

Figure 1A:
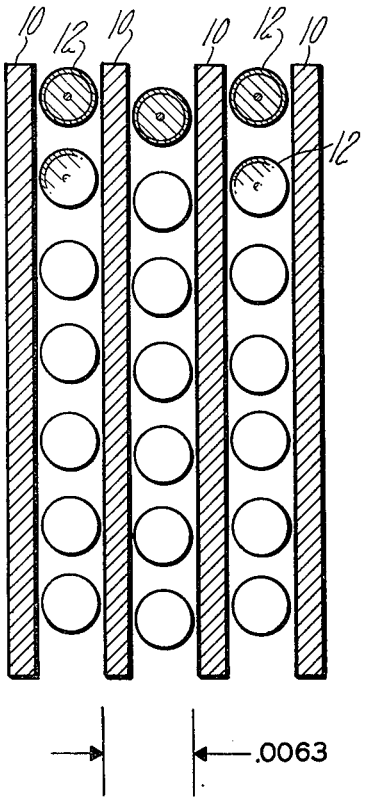
FIGS. 1A and 1B schematically illustrate the consolidation step practiced in accordance with the present invention.
Figure 1B:
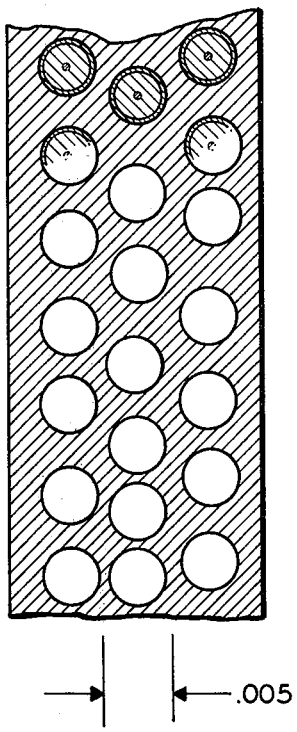

The BORSIC/beta-titanium alloy composites were completed using the fiber-foil consolidation process depicted schematically in FIG. 1. Alternate layers of the scratch-brushed and degreased beta-titanium matrix foil 10 and planes of evenly spaced parallel fibers 12 as shown in FIG. 1A, were vacuum hot pressed using a flat open die to produce the structure of FIG. 1B.

Figure 2:
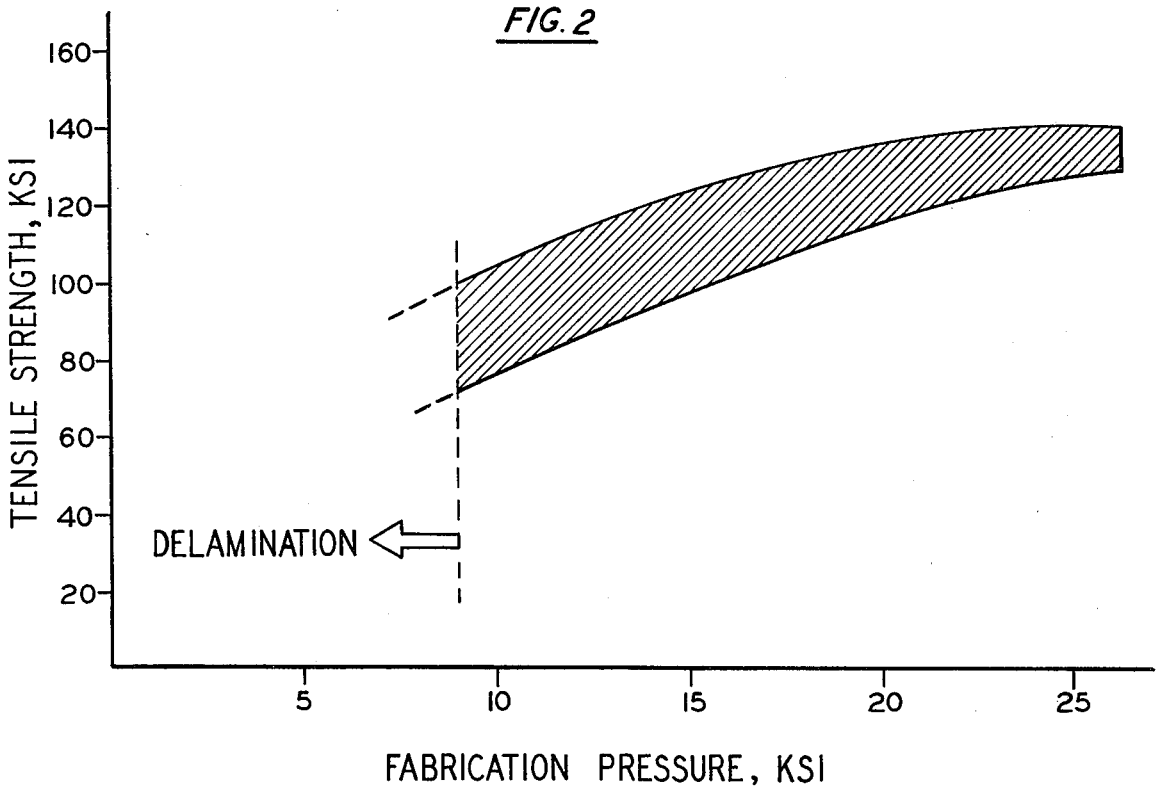
FIG. 2 is a graph of tensile strength vs. fabrication pressure for composite materials fabricated in accordance with the present invention.

As depicted in FIG. 2, which is a plot of tensile strength vs. fabrication pressure for Ti-6Al-4V titanium alloy matrix material, the effects of fabrication pressure on composite strength and integrity are marked. Materials fabricated at pressures below 8 to 9 ksi delaminated during handling or machining and could not be tested. Higher fabrication pressures produced macroscopically sound panels which exhibited increased strength with further increases in fabrication pressure. However, these increases of strength with fabrication pressure ceased in the range of 22 to 23 ksi. Metallographic examination has revealed that the highest strength composite material, fabricated above 22 ksi, is invariably well bonded and macroscopically sound. Composite material fabricated below 22 ksi will usually exhibit incomplete matrix bonding.

It is to be noted that the results of FIG. 2 were achieved by a constant time at temperature of 1 hour. Further, the bulk of the testing performed was for longitudinal tensile strength since the fiber-matrix interaction, which resulted in the formation of brittle layers of intermetallic compound in the prior art, lead to significant longitudinal strength reduction. Finally, it is to be noted that the FIG. 2 results were achieved employing a volume fraction of reinforcing fibers of 47. For aerospace applications a volume fraction in the range of 45 to 65 is usually considered desirable.

Figure 3:
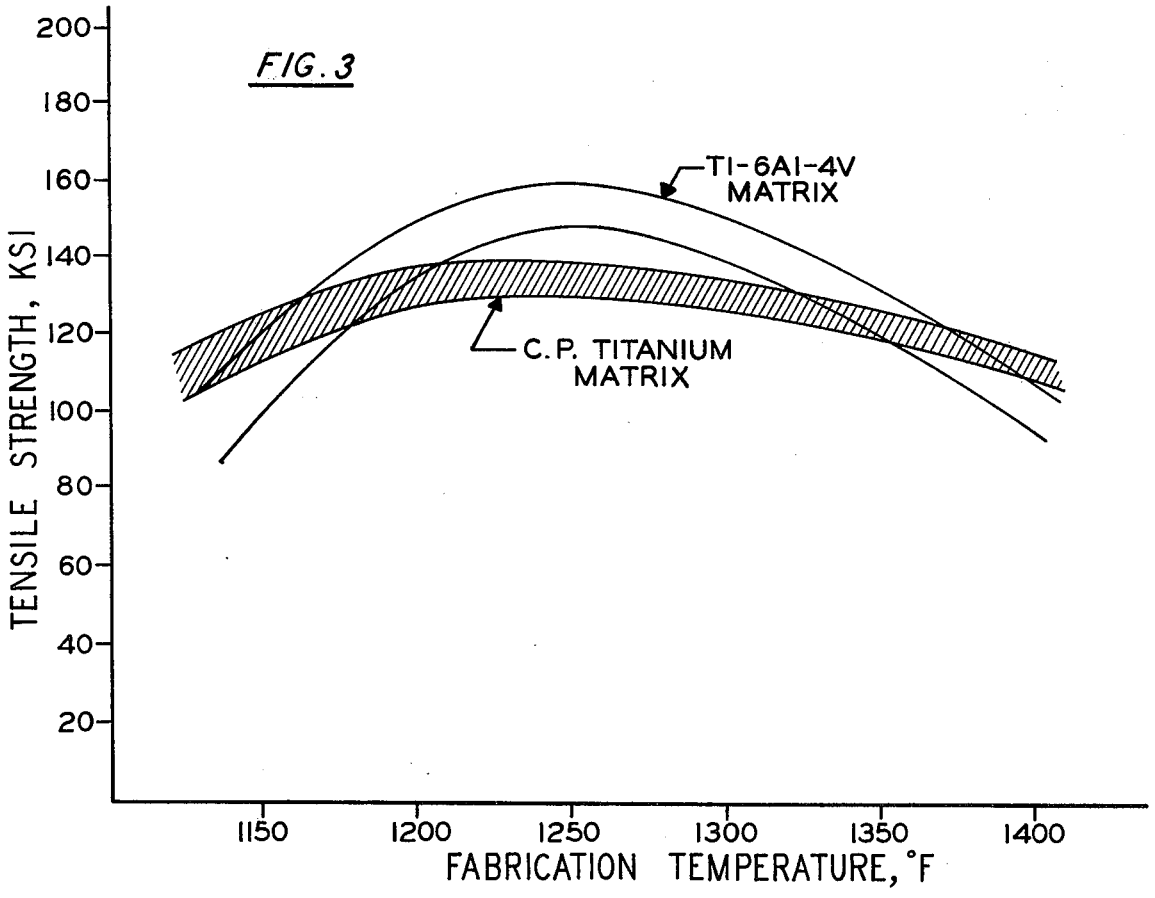
FIG. 3 is a graphical representation of the effects of fabrication temperature on the tensile strength of composite materials fabricated in accordance with the present invention.

FIG. 3 depicts the effects of fabrication temperature and matrix alloy on the tensile strength of fiber-reinforced composites employing both C.P. titanium and Ti-6Al-4V with a volume fraction of reinforcing fibers of 47. The consolidation pressure employed in measuring the effects of temperature on tensile strength was 25 ksi and the time at the various temperatures was, as in the case of the FIG. 2 results, 1 hour. Maximum strength for beta-titanium alloy composite materials was achieved within the narrow temperature range of 1250° F to 1275° F. The lower end of this fabrication temperature range represents the lowest temperature where complete consolidation and bonding is accomplished. Reduced tensile strength accompanied the use of fabrication temperatures above 1275° F. It is believed that such reduced tensile strength results from a fiber-matrix interfacial reaction and increased levels of residual stress. It is also noteworthy that the tensile strength of the beta-titanium alloy matrix composite materials is significantly greater than that of BORSIC fiber reinforced commercially pure (C.P.) titanium matrix composites.

To summarize the present invention, it has been discovered that interfacial reactions between reinforcing boron fibers and titanium matrix material can be substantially eliminated, thereby producing a fiber-reinforced titanium alloy matrix composite material of exceptional strength and utility, by employing silicon coated bond fibers and beta-titanium alloy matrix material foil and consolidating a stack of such fiber-reinforced foils in a vacuum hot press with an applied pressure in excess of 22 ksi and a temperature in the range of 1250° F. to 1275° F. Strict observation of these critical parameters will produce a composite material having increased temperature capability, better erosive environment durability, improved tensile strength and thus improved shear, transverse and off-access properties when compared to previously available titanium matrix composite materials.

While a disclosed embodiment has been shown and described, various modifications and substitutions may be made thereto without departing from the spirit and scope of the invention. Accordingly, it is to be understood that the present invention has been described by way of illustration and not limitation.

What is claimed is:

1. A method of producing a composite metallic material comprising the steps of:

arranging a plurality of silicon coated boron fibers in evenly spaced relationship on a first surface of a beta-titanium alloy foil;

stacking a plurality of foil-fiber arrangements to provide a multilayer structure consisting of alternate layers of foil and fibers having a fiber volume fraction of 45–65 percent;

compacting the multilayer structure by applying a pressure of at least 22 ksi; and subjecting the multilayer structure to a temperature in the range of 1250° F to 1275° F while maintaining the application of pressure.

2. The method of claim 1 wherein the steps of compacting and simultaneously subjecting the multilayer structure to an elevated temperature are performed in a vacuum.

3. The method of claim 2 further comprising:

selecting the beta-titanium alloy foil from a group of alloys including Ti-6Al-4V, Ti-13V-11Cr-3Al, Ti-11.5Mo-6Cr-4.5Sn and Ti-3Al-8V-6Cr-4Mo-4Zr.

4. The method of claim 3 wherein the step of positioning comprises:

fugitive binding the fibers with a material which decomposes to form gaseous reaction products during the vacuum hot compacting.

5. The method of claim 1 further comprising:

selecting the beta-titanium alloy foil from a group of alloys including Ti-6Al-4V, Ti-13V-11Cr-3Al, Ti-11.5Mo-6Cr-4.5Sn and Ti-3Al-8V-6Cr-4Mo-4Zr.

6. The method of claim 1 wherein the step at positioning comprises:

fugitive binding the fibers with a material which evaporates during the vacuum hot compacting.

7. A fiber-reinforced composite material produced in accordance with the process of claim 2 and comprising hot vacuum pressed alternate layers of a beta-titanium alloy foil and evenly spaced silicon coated boron fibers having a high length-to-diameter ratio.

* * * * *